United States Patent [19]

Spies

[11] 4,051,657

[45] Oct. 4, 1977

[54] SPINNING-RING BEARING AND SUPPORT

[75] Inventor: Alfons Spies, Munich, Germany

[73] Assignee: Dr. Johannes Heidenhain, GmbH, Traunreut, Germany

[21] Appl. No.: 598,791

[22] Filed: July 24, 1975

[30] Foreign Application Priority Data

July 25, 1974 Germany ..... 2435770

[51] Int. Cl.[2] ..... D01H 7/56; D01H 7/64

[52] U.S. Cl. ..... 57/124; 308/26

[58] Field of Search ..... 57/122, 124; 308/15, 308/26

[56] References Cited

U.S. PATENT DOCUMENTS

| | | | |
|---|---|---|---|
| 1,165,012 | 12/1915 | Maloney | 57/122 |
| 2,454,707 | 11/1948 | Meyers et al. | 57/122 |
| 3,093,957 | 6/1963 | Tetreault | 57/122 |
| 3,611,697 | 10/1971 | Greb | 57/124 |

*Primary Examiner*—Richard C. Queisser
*Assistant Examiner*—Charles Gorenstein
*Attorney, Agent, or Firm*—Ernest F. Marmorek

[57] ABSTRACT

An air bearing for a spinning- or a twisting ring suitable for use in the textile industry has a stator which is mounted on a spring-loaded damping absorber system. The absorber has a linear spring-curve in response to small deflections which rises progressively as the stator is further deflected.

6 Claims, 2 Drawing Figures

SPINNING-RING BEARING AND SUPPORT

HEADING-REFERENCE TO RELATED APPLICATIONS

Figure 1:
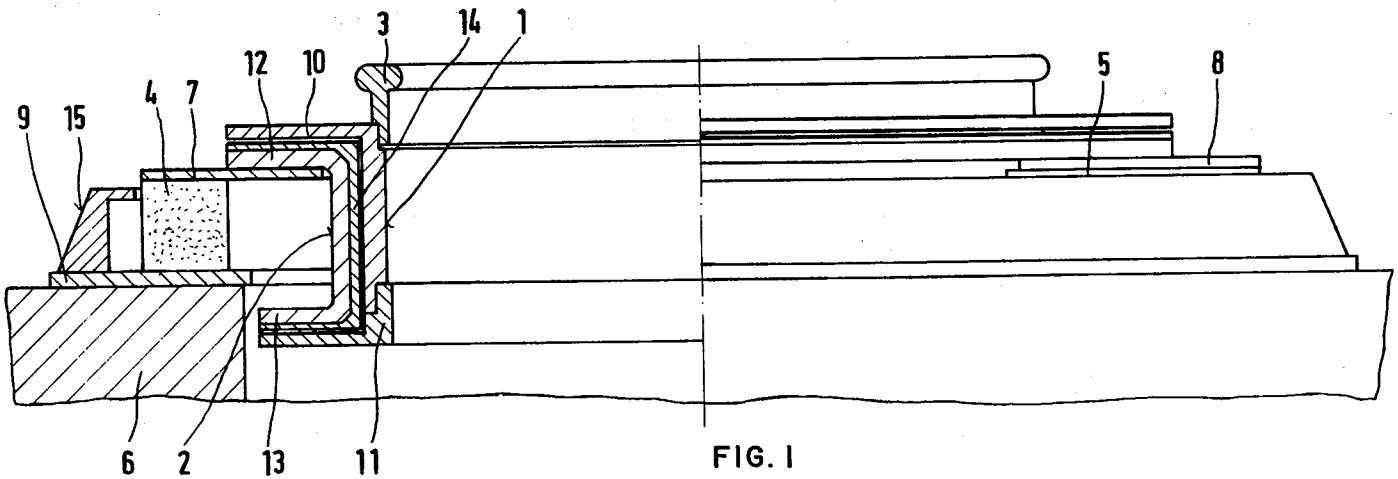
Figure 2:
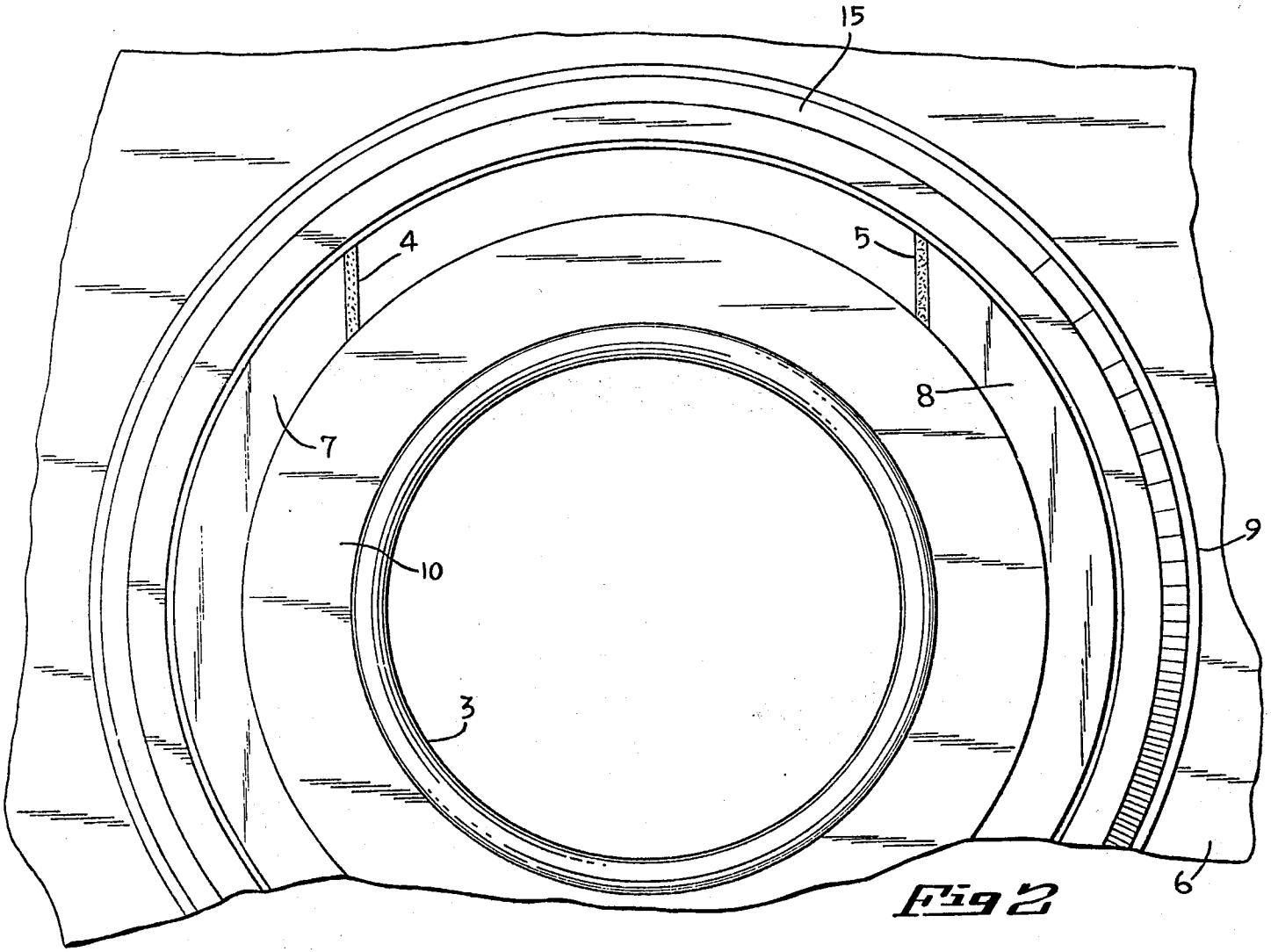

Reference is had to applicant's co-pending patent applications Ser. No. 598,789 and Ser. No. 598,790, both of which were filed concurrently with the instant patent application.

An air bearing for a spinning- or twisting-ring suitable for use in the textile industry has a stator which is mounted on a spring-loaded damping absorber system. The absorber has a linear spring-curve in response to small deflections which rises progressively as the stator is further deflected.

The invention concerns an air-bearing for a spinning or twisting-ring as used in the textile industry.

The object of the invention is to create an air-bearing of simple construction, which runs without interruption.

SUMMARY OF THE PRESENT INVENTION

This invention provides air bearing for a spinning or twisting-ring, including a bearing stator mounted on a spring-loaded and damping absorber-system, whose characteristic spring-curve is linear over a small range of deflection and then rises progressively as the bearing stator is further deflected.

In a preferred embodiment of the invention, the absorber-system for the bearing stator consists of two ring segments which are diametrically opposite each other, and are surrounded by a rigid stop which, when the bearing is stationary, is opposite and in close proximity to the segments of the ring.

IN THE DRAWING

An embodiment of the invention will be described by way of example, with reference to the sole accompanying drawing which is a partially cut-away side view of a spinning ring bearing.

A bearing for a ring 3 consists of a rotor 1 and a stator 2. The bearing stator 2 is mounted, floating in rubber, on a spinning-stand 6 by means of two ring segments 4 and 5, which are diametrically opposite to each other.

The ring segments 4 and 5 are enclosed concentrically by a stop 15 which, when the bearing is stationary, is opposite and in close proximity to the ring segments 4/5. The stop 15 serves to limit the vibration- amplitudes of the stator 2 in the radial direction. The absorber-system 4/5 for the bearing stator 2 is freely deformable over a small range, while on further deflection, in order to produce a progressive stiffening, it is deformable to a more limited degree per unit force.

The bearing for the ring 3 is, an aerodynamic axial/-radial bearing. The bearing rotor 1 consists of the ring 3 and two flanges 10 and 11 directed outward. The bearing stator 2 has annular flanges 12 and 13, which are opposite each other and in close proximity to the bearing-surfaces of the rotor 1. The inner surfaces of the metallic stator 2 have a coating 14 of synthetic material, in which spiral grooves are formed. The ring segments 4 and 5 are mounted on the bearing stator 2 by means of fixing elements 7/8 and secured to the spinning-stand 6 by means of an annular element 9.

What is claimed is:

1. An air bearing for a spinning or twisting ring, comprising a bearing stator mounted on a resilient dampening receiver system whereby radial deflections of said stator result in corresponding deflections in said receiver system, and stopping means for limiting the radial vibration amplitudes of said stator, said stopping means cooperating with said receiver system to allow said receiver system to be completely, freely deformable within a small range of deflections and for larger deflections attains progressive rigidity and becomes only conditionally, freely deformable.

2. In an aerodynamic bearing for air cushion supporting of a spinning or twisting ring, both axially and radially, the combination with a stator and a rotor supported by and rotatable relative to said stator, of mounting means for said stator comprising stopping means and a resilient dampening absorber system cooperating with said stopping means to provide a characteristic spring-curve which is linear over a range of small radial deflections and thence rises progressively for larger deflections.

3. The aerodynamic bearing as claimed in claim 2, wherein said absorber system comprises two resiliently flexible ring segments each having inside and outside radial surfaces and being oppositely disposed and substantially concentric relative to said stator, said stopping means being disposed in close proximity to the outside radial surfaces of said ring segments, when at rest, said small radial deflections being substantially deflections of said absorber system until there occurs abutment between a portion of the outside radial surface of at least one of said ring segments with said stopping means.

4. The aerodynamic bearing as claimed in claim 3, wherein said ring segments are composed of rubber.

5. The aerodynamic bearing as claimed in claim 3, wherein said ring segments are composed of resilient synthetic material.

6. In an aerodynamic bearing for air cushion supporting of a spinning or twisting ring, both axially and radially, comprising a stator, a rotor supported by and rotatable relative to said stator, the improvement comprising:

said rotor having an annular shape and including upper and lower radially extending projections;

said stator having an annular shape and being disposed concentric to said rotor and including upper and lower radially extending projections, whereby said stator substantially engages said rotor to define a small air gap therebetween for the air cushion;

mounting means for said stator comprising a resilient dampening absorber system including two resiliently flexible ring segments each having inside and outside radial surfaces and being oppositely disposed and substantially concentric relative to said stator, and connecting means operable to connect said stator to said ring segments to be supported thereby; whereby deflections of said stator result in corresponding deflections in said ring segments; and stopping means disposed in close proximity to the outside radial surface of said ring segments when at rest, said absorber system having a characteristic spring-curve which is linear for radial deflections until there occurs abutment between a portion of the outside radial surface of at least one of said ring segments with said stopping means and thence rises progressively for larger deflections.

* * * * *